United States Patent [19]

Bopst, III

[11] 4,248,659

[45] Feb. 3, 1981

[54] ANGULAR ATTACHMENT FOR INSTANTANEOUS SEALING OF CRACKS

[76] Inventor: John H. Bopst, III, 409 Chalfonte Dr., Baltimore, Md. 21228

[21] Appl. No.: 93,678

[22] Filed: Nov. 13, 1979

[51] Int. Cl.[3] ..... B44C 7/02; D06F 75/32

[52] U.S. Cl. ..... 156/574; 156/577; 156/579; 156/583.1; 219/245; 219/249

[58] Field of Search ..... 156/574, 577, 579, 583.1, 156/233, 465, 468, 523, 527, 515; 219/245, 249

[56] References Cited

U.S. PATENT DOCUMENTS

| | | | |
|---|---|---|---|
| 2,366,675 | 1/1945 | Petty | 156/577 |
| 2,819,374 | 1/1958 | Swartz | 219/249 |
| 2,838,647 | 6/1958 | Gorlinski | 156/579 |
| 3,007,837 | 11/1961 | Goode, Jr. | 156/577 |
| 3,138,512 | 6/1964 | Partin | 156/574 |
| 4,160,688 | 7/1979 | Brooks et al. | 156/574 |

*Primary Examiner*—Michael G. Wityshyn
*Attorney, Agent, or Firm*—John F. McClellan, Sr.

[57] ABSTRACT

An angle soleplate for use as part of a heating type crack sealing system for applying thermosetting tape in an interior angle or corner joint formed by adjoining walls of a building, or for drying drywall tape already applied there, includes a thermally conductive sleeve with a "V" bottom therealong joining a rectangular inverted-"U"-section mounting portion; the contour of the "V" bottom preferably has a slight rounding at the apex of the "V" for reducing working pressure on the tape at a corner, and the invention preferably provides for detachable attachment to permit greater versatility in use of the crack sealing system.

5 Claims, 6 Drawing Figures

ANGULAR ATTACHMENT FOR INSTANTANEOUS SEALING OF CRACKS

This invention relates generally to hand tool accessories, and particulary to an angle adapter for an electrically heated crack sealing tape dispenser of the type disclosed in my U.S. Patent application Ser. No. 835,458 filed Sept. 22, 1977 for System for Instantaneous Sealing of Cracked Lines in Plaster now U.S. Pat. No. 4,174,249 granted Nov. 13, 1979.

This prior application discloses a crack sealing system in the form of an elongate, electrically heated flat plate with an upstanding handle having spooling provision for thermosetting-resin metal tape which is led through a guide at the front and then passes between the heated flat plate and a wall on which the tape is to be applied to seal a crack.

In the construction of drywall building walls, as for enclosing rooms, open joints between wall panels are customarily sealed by joint compound which is spread an inch or so on each side of the crack filled. Paper tape is then placed over the compound and rolled. This method requires an expensive setting-up or drying period of several hours, or in some cases a day, before further work such as feathering the edges of the tape and painting can be done on the walls. To some extent the same type delay is encountered when sealing structural cracks in old work. Further, working corners is considerably more difficult using ordinary methods than working flat surfaces.

Objects of the present application are to provide an angle soleplate which can be detachably affixed on the flat plate of my aforesaid crack sealing system to adapt it for applying thermosetting tape in an interior angle or corner joint formed by adjoining walls of a building, or for thermally drying drywall tape already applied there, as the case may be.

Further objects of the invention are to provide an angle soleplate which is thermally efficient so that it distributes heat quickly and uniformly without excessive loss, and which is at the same time mechanically efficient in applying tape, is lightweight but durable, easy to attach and detach, which requires no adjustment, and which is easy to use.

In brief summary given as cursive description only and not as limitation, the invention includes a sleeve with a "V" bottom joining a rectangular inverted "U" section mounting portion.

The above and other objects and advantages will become more readily apparent on examination of the following description, including the claims in which:

Figure 1:
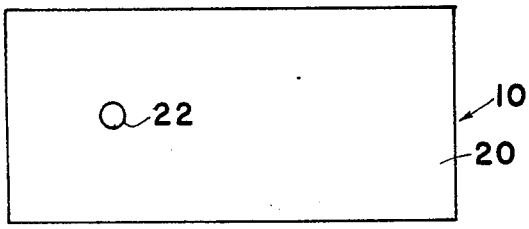
FIG. 1 is a top plan view.

FIG. 1 shows the invention, an angular soleplate 10 or accessory for a crack sealing system. The top 20 is rectangular and has a hole 22 for a machine screw to attach it to the tool with which it will be used. Preferably the hole is on the long centerline, about ¼ the length from the front end.

Figure 2:
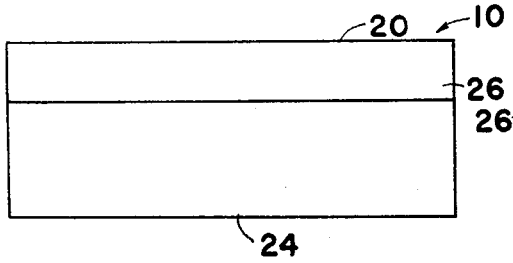
FIG. 2 is a side elevational view.
Figure 3:
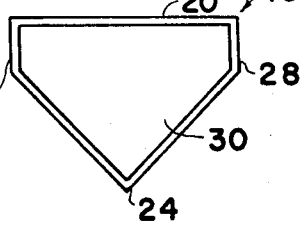
FIG. 3 is an end elevational view.

FIG. 2 and FIG. 3 show the side and end aspects of the invention 10, which is a unitary sleeve-like member constructed of sheet metal, preferably chrome plated mild steel, about 0.020 inch (0.5 mm) thick. The bottom 24 forms an equilateral downwardly protrusive "V", preferably at right angles, and adjoins the respective sides 26, 28 at equal angles. The sides are parallel with each other and join the top 20 at right angles and the ends 30 are preferably open, tending to stabilize heat build up, simplifying fabrication and lowering cost. The unit is symmetrical about the long centerline.

Figure 4:
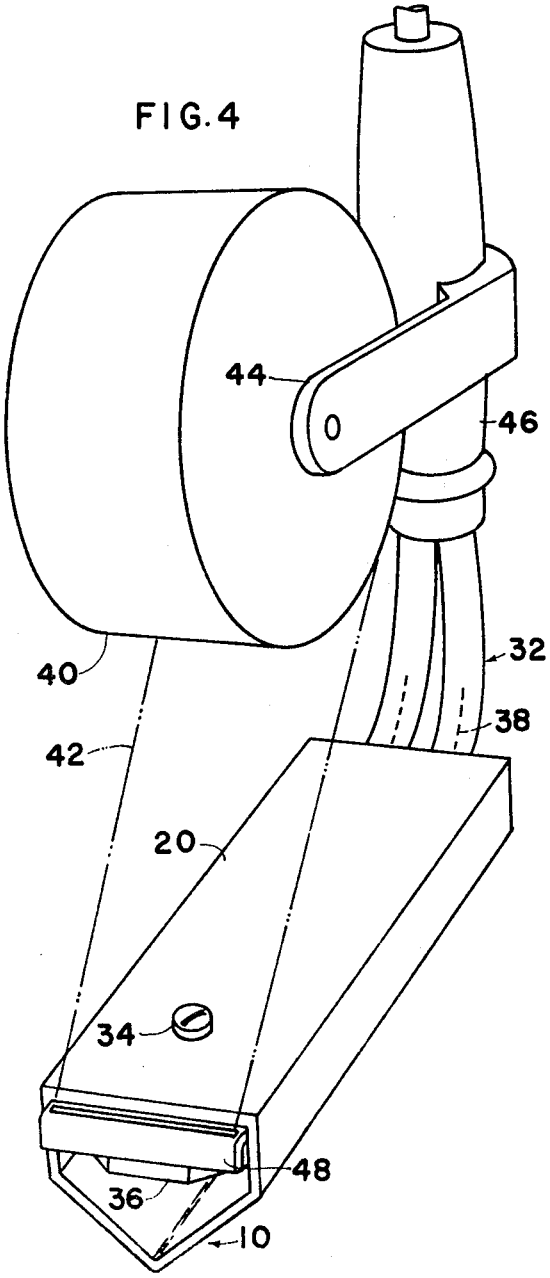
FIG. 4 is a perspective view of the invention in place on a crack sealing sysem, with tape end-portion shown in phantom lines.

FIG. 4 shows the invention 10 mounted on a crack filling system 32, adapting the system to seal tape over openings inside corners at wall junctions. Screw 34 passes through the top 20 of the angular soleplate unit and threads into an appropriate matching hole in the top of the soleplate 36 of the crack filling system, securing the two together. The soleplate 36 of the crack sealing system is electrically heated by wire 38, and is in the shape of a rectangular parallelepiped with the broad faces horizontal, and the angular adapter soleplate 10 closely fits the sides and top for best heat transfer and lateral support. A spool 40 of thermosetting tape 42 (phantom lines) has mounting 44 to the handle 46 as part of the crack sealing system and the tape 42 leads forward and down through a guide 48 then passes rearwardly under the angular soleplate 10 to be heated by it and pressed by it into a corner for sealing an open joint or crack.

Figure 5:
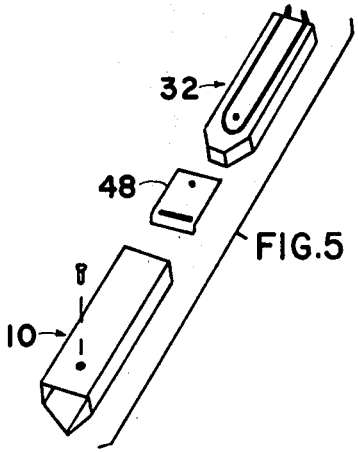
FIG. 5 is an exploded assembly detail.

FIG. 5 details assembly of the units 10, 48, 32.

Figure 6:
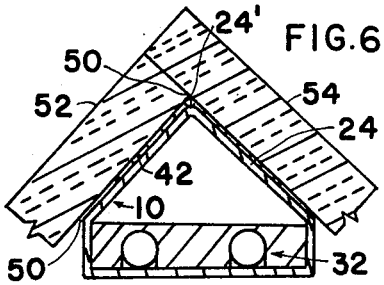
FIG. 6 is an end view partly in section of the invention in use with a crack sealing system sealing a corner wall-joint.

FIG. 6 shows a typical joint 50 between wall panels 52, 54 being sealed by tape 42 applied by pressure and heat of the "V" bottom 24 of the angular soleplate 10 mounted on the crack sealing system 32 (shown fragmentarily). The apex 24' of the "V" bottom is rounded slightly to provide a desirable radius (preferably about 1/16 inch (1.5 mm) radius) at the corner, and to reduce working pressure on the tape at the corner.

Although the invention has been described as made of mild steel it will be appreciated that it can be, for example, made of other material, such as plated copper, or such as stainless steel, to give two practical extremes on conductivity. This is because of the inherently good heat transfer provided by the design which contacts the heated soleplate of the crack sealing system on three sides and receives radiative transfer from it on the fourth side. It will be evident that the unitary nature of the device adapts it for quantity production at a very low cost by sheet metal stamping techniques, that the guide plate could be an integral forward part of the invention, and that the invention could be attached by welding or other suitable means instead of by screw.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. An accessory for a crack sealing system of the type having a rectangular parallelepiped shaped heated soleplate for applying and sealing tape over a wall crack, the accessory comprising means adapting a said crack sealing system for applying and sealing tape over a said crack when the crack is at the inside corner formed by the junction of two wall panels disposed substantially at right angles and including a sleeve-like member having a pressing and heating bottom which is "V" shaped and downwardly protrusive when positioned beneath a said soleplate, respective parallel sides joined to the pressing and heating bottom, a top joined to the respective sides at right angles, and means for securing the sleeve-like member to a said crack sealing system.

2. An accessory as recited in claim 1, the ends of said sleeve-like member being open.

3. An accessory as recited in claim 1, the included angle of said "V" shape of the bottom being a right angle.

4. An accessory as recited in claim 1, the sleeve-like member being made of sheet metal.

5. An accessory as recited in claim 1, the apex of the "V" being rounded.

* * * * *